US006393890B1

(12) United States Patent
Scholeck

(10) Patent No.: US 6,393,890 B1
(45) Date of Patent: May 28, 2002

(54) BEND-STRAIGHTENING MACHINE WITH DRIVE UNIT MOUNTED ON TOP OF PRESS FRAME

(75) Inventor: Andrew Scholeck, Schuylkill Haven, PA (US)

(73) Assignee: Eitel Presses, Inc., Orwingsburg, PA (US)

( * ) Notice: Subject to any disclaimer, the term of this patent is extended or adjusted under 35 U.S.C. 154(b) by 0 days.

(21) Appl. No.: 09/613,378

(22) Filed: Jul. 11, 2000

Related U.S. Application Data

(60) Provisional application No. 60/143,274, filed on Jul. 12, 1999.

(51) Int. Cl.[7] ..... B21D 3/10
(52) U.S. Cl. ..... 72/390.3; 72/452.7
(58) Field of Search ..... 72/390.3, 452.7, 72/452.5; 100/292

(56) References Cited

U.S. PATENT DOCUMENTS 306,914 A * 10/1884 Fritz ..... 100/292
3,797,385 A * 3/1974 Goff ..... 100/292
5,839,315 A 11/1998 Kubik

FOREIGN PATENT DOCUMENTS

DE 0 979 690 A1 2/2000

* cited by examiner

*Primary Examiner*—Lowell A. Larson
(74) *Attorney, Agent, or Firm*—Anthony J. Casella; Gerald E. Hespos

(57) ABSTRACT

The invention relates to a bend-straightening machine for long workpieces (21), said machine having workpiece holding fixtures (19) arranged on a machine base (2) to grip the ends of the workpiece (21) in a rotatable manner. The machine has at least two straightening bases (22) arranged a distance apart on the machine base (2) for support of the workpiece in its vertical direction. At least one straightening punch (17) is provided between the straightening bases (22) to act upon the workpiece. The straightening punch (17) is mounted to an actuating mechanism which can be moved towards the workpiece and away from it by means of a driving mechanism to be embodied as a ram (5) which holds the straightening punch in the vertical alignment of the workpiece and which can be moved in a vertical plane by means of the drive mechanism. This design assures precise, directionally accurate straightening of the workpiece with a simple method of construction.

14 Claims, 2 Drawing Sheets

BEND-STRAIGHTENING MACHINE WITH DRIVE UNIT MOUNTED ON TOP OF PRESS FRAME

This application claims the benefit of the filing date of Provisional Patent Application, U.S. Ser. No. 60/143,274 filed Jul. 12, 1999.

BACKGROUND OF THE INVENTION

1. Field of the Invention

The invention relates to a bend-straightening machine for long workpieces, said machine having workpiece holding fixtures on a machine base to grip the ends of the workpiece in a rotatable manner, having at least two straightening bases arranged a distance apart on the machine base for support of the workpiece in its vertical direction, having at least one straightening punch arranged between the straightening bases to act upon the workpiece as well as having an actuating mechanism which can be moved towards the workpiece and away from it by means of a driving mechanism.

2. Description of the Related Art

A bend straightening machine of similar concept is known from U.S. Pat. No. 5,839,315, owned by the assignee of this application. In U.S. Pat. No. 5,839,315, the actuating mechanism is based upon cam on roller technology, which utilizes a camshaft mounted in the machine table below the straightening bases. The actuating mechanism is designed as a bridge which holds the straightening ram in vertical alignment of the workpiece and the bridge can be moved in a vertical plane by means of a drive mechanism coupled to the camshaft. The bridge is spring-mounted on the base plate of the machine to urge the ram to be in constant engagement with the camshaft to ensure precise alignment with the workpiece.

The known bend-straightening machine has a fundamental disadvantage in that the tonnage and stroke capability of the machine are limited by ergonomic considerations when considering the floor-to-workpiece centerline distance. Also, due to the plurality of springs supporting the bridge, deformation of any of springs will lead to an asymmetrical load on the workpieces.

The object of the present invention is to further refine a bend-straightening machine of the type stated above which provides for precise, directionally accurate straightening of the workpiece while at the same time allowing machine tonnage and ram stroke to be considered separately from ergonomic floor-to-workpiece centerline considerations.

SUMMARY OF THE INVENTION

The objective of the subject invention is attained in a bend-straightening machine of the type stated above in such a manner that the actuating mechanism is designed as a ram which holds the straightening punch in the vertical alignment of the workpiece and said ram can be moved in the vertical plane by means of the actuating mechanism. The actuating mechanism in this case consists of cam on roller technology which utilizes a camshaft which is mounted to a rigid machine frame above the workpiece centerline. In this case of a rotationally symmetrical workpiece, vertical alignment is understood to be its axis.

Particular significance is attached to placing the cams and camshaft above the workpiece centerline in this bend-straightening machine, in that, cam design can be considered separately from ergonomic workpiece centerline-to-floor distance considerations. Additionally, this machine concept maintains all the advantages of precise, directionally accurate straightening known from U.S. Pat. No. 5,839,315.

The invention described above consists of a rigid machine frame which comprises a machine base, vertical posts, and a machine top plate. Advantageously mounted within the machine frame is the ram which is supported perpendicular to its direction of movement by linear guides mounted to the vertical posts.

A particular embodiment of the invention provides for the ram to be spring-mounted to the machine top plate. The advantage of spring-mounting the ram is that the drive mechanism exclusively serves the purpose of moving the straightening punch which is supported in the ram in the direction of the workpiece, and the latter against the force of one or more springs which act between the machine top plate and the ram. By having a spring centrally located on the machine top plate and ram guided by linear guides, the ram will always provide a symmetrical load on the workpiece.

Advantageously, the drive mechanism has a motor and a shaft propelled by it as fixedly mounted units and at least one cam disk fixedly joined to the shaft, said cam disk interacting with a projection of the ram. The movement of the ram thus takes place by means of a driven cam disk which interacts with the projection on the ram. Basically, such a construction is suitable for producing both the downward motion as well as the upward motion of the ram. If the projection rests against the outside of the cam disk and a spring exerting a restoring force acts upon the ram, the spring ensures that the projection always rests against the cam disk and is more or less raised or lowered depending on the particular angular position of the cam disk. However, it is also conceivable to provide the disk with a groove in the shape of a curve in which the projection engages essentially without play when seen across the breadth of the groove. Depending on the angular position of the cam disk, the projection which produces the connection to the ram is actively raised or lowered. The projection is advantageously designed in the form of a roller so that the relative motion between the projection and cam disk can take place largely without friction.

An embodiment of particularly simple design provides for the shaft to be rotatably supported on bearings mounted to the machine top plate and for cam disks to be connected to the shaft at opposite sides of the machine top plate, said cam disks interacting with projections.

If present, the springs producing the upward movement of the ram should be designed as compression springs placed between a spring mounting bracket and the top surface of the machine top plate.

Additional features of the invention are presented in the dependent claims, the description of the drawings and in the drawings themselves, whereby it is pointed out that all individual features and combinations of individual features are essential to the invention.

BRIEF DESCRIPTION OF THE DRAWINGS

The invention is illustrated in the drawings by means of an exemplary embodiment without being limited to the latter. In schematic representation.

DETAILED DESCRIPTION OF THE INVENTION

Figure 1:
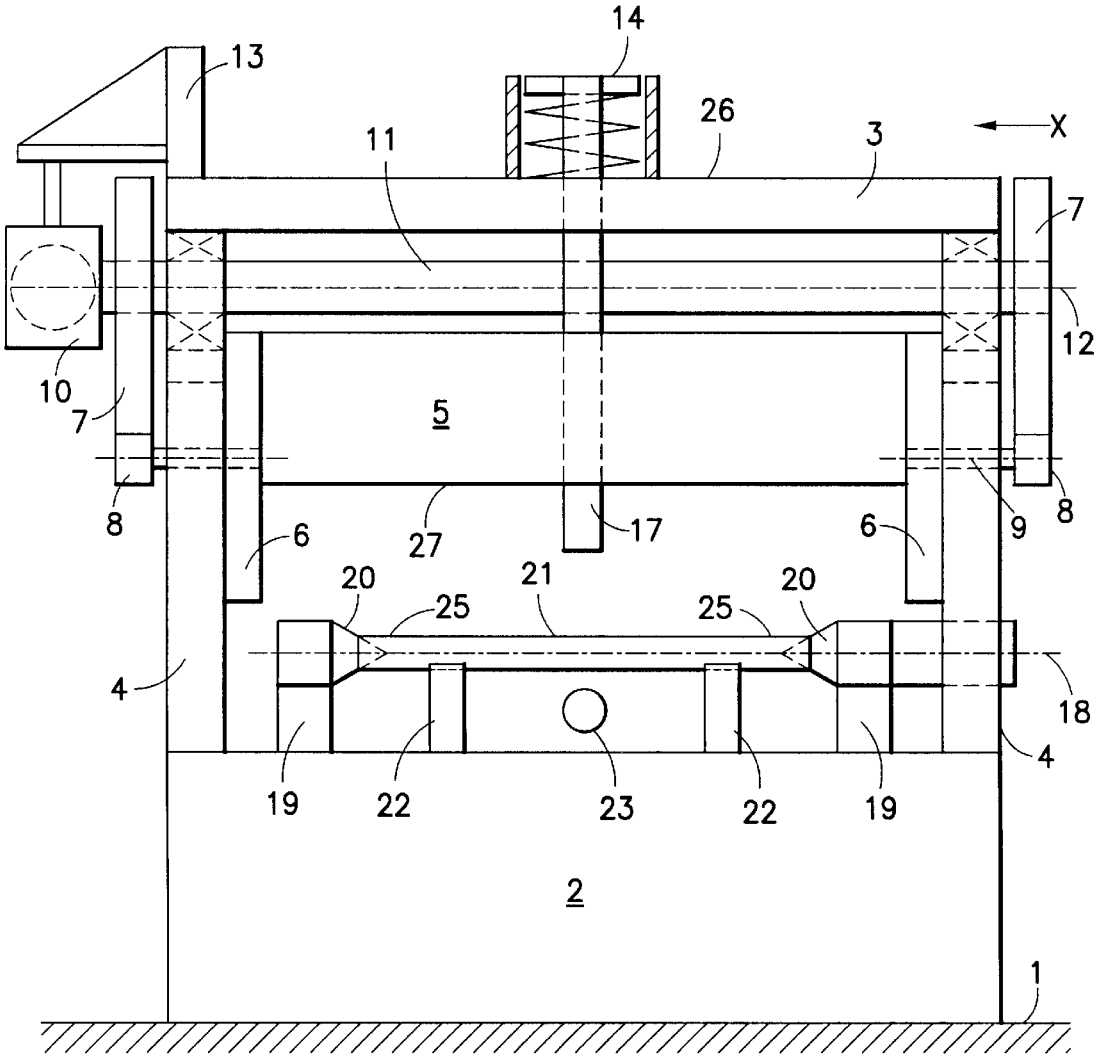
FIG. 1 shows a front view of the bend-straightening machine in accordance with the invention.
Figure 2:
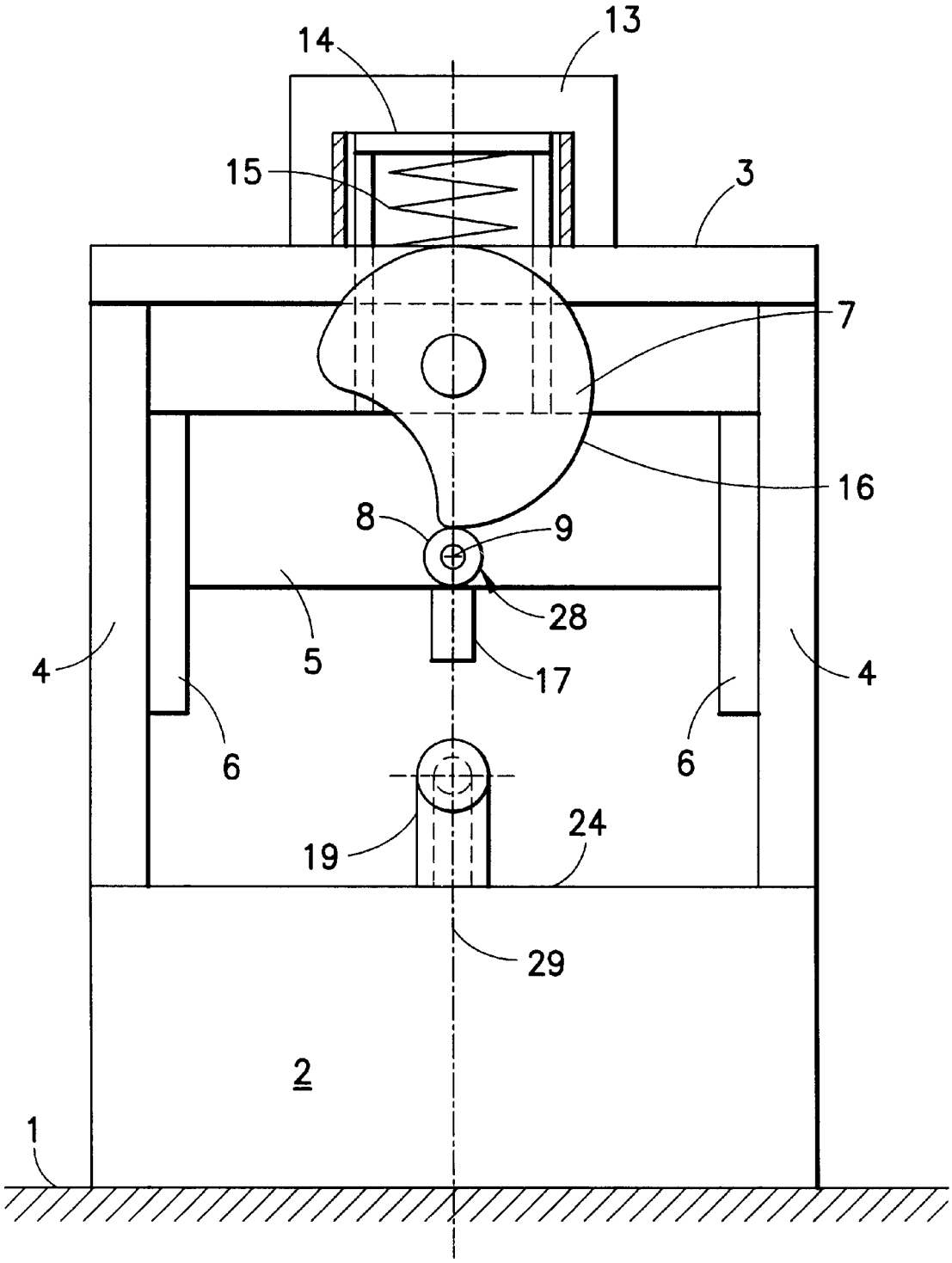
FIG. 2 shows a side view of the bend-straightening machine as viewed along arrow X in FIG. 1.

Referring to the FIGS., a machine base 2 rests on the floor. In the region of its upper, horizontal surface 24, machine base 2 holds two workpiece holding fixtures 19. These serve to grip in a rotatable manner the ends 25 of a workpiece 21 which may, for instance, be present in the form of a cylindrical rod. The workpiece holding fixtures 19 are, for instance, in the form of spindle sleeves with centers 20, which engage matching countersinks in the ends of workpiece 21. In the region of the upper surface 24, the machine base is provide with two straightening bases 22 arranged at a distance apart and between workpiece holding fixtures 19 for support of workpiece 21 in the vertical direction. A measuring instruments 23 for determining the deflection of a workpiece 21 is supported on the machine base 2 and is centered between the two straightening bases 22.

A rigid frame is constructed, consisting of the machine base 2, four vertical posts 4, and a machine top plate 3. Mounted within the rigid frame is the ram 5 whose lower surface 27 is arranged so that it is parallel to the upper machine base surface 24. Optimally, the ram 5 is supported perpendicular to its direction of movement by linear guides 6 which are mounted to the vertical posts 4. The ram 5 is supported vertically through the use of one or more spring brackets 14 and one or more compression springs 15 which connect the spring bracket to the top surface 26 of the machine top plate 3.

A shaft 11 is rotatably supported on bearings and is at the same time fixed in an axial direction to the machine top plate 3 above the ram 5. The axis of rotation 12 of shaft 11 is arranged parallel to the axis of rotation 18 of the workpiece 21 and above it. Shaft 11 projects from both sides of the machine top plate 3 and has a cam disk 7 fixedly mounted to it in the immediate vicinity of the machine top plate 3. In the region of one of its ends, shaft 11 can be propelled by a drive mechanism 10 comprising an electric motor and a step-down gear unit. The drive mechanism 10 is supported off of the machine top plate 3 by means of a motor mounting bracket 13.

A roller 8 is rotatably mounted to the ram 5, whereby the axis of rotation 9 of roller 8 is arranged parallel to the axis of rotation 12 of shaft 11 and below it. One or more compression springs 15 acting on the ram 5 through one or more spring mounting brackets 14 press the curved peripheral surfaces 28 of both rollers 8 which are joined to the ram 5 against the curved peripheral surfaces 16 of the cam disks 7 interacting with them. The cam disks are designed in such a way that the feed travel of the ram 5 corresponds to an angle of traverse of approximately 270° of the particular cam disk 7 in order to complete the bend-straightening operation.

In the vertical alignment of the workpiece 21, the ram 5 holds straightening punch 17 which can be moved with the ram 5. This straightening punch 17 is arranged in vertical alignment between the two straightening bases 22 and is positioned symmetrically to plane 29 which passes through the axis 12 of shaft 11 and axis 18 of workpiece 21. This ensures the straightening punch 17 always acts upon workpiece 21 precisely from above when the ram 5 is moved in a vertical direction, independent of the diameter of the workpiece.

The drawings illustrate the embodiment of the bend-straightening machine in accordance with the invention in a highly simplified representation. It is readily understandable that this machine can be extensively modified within the scope of the invention. Thus, the straightening bases 22 and the straightening punch 17 are expediently movable in the longitudinal direction of workpiece 21, an additional drive mechanism to rotate the workpiece can be provided, and the feed travel of the ram 5 can also take place by means other than cam disks.

What is claimed is:

1. A bend-straightening machine for straightening a workpiece, said machine comprising:

a machine base (2) having first and second spaced-apart side surfaces and an upper surface (24) extending therebetween, at least two workpiece holding fixtures (19) mounted to said upper surface (24) of said machine base (2), said workpiece holding fixtures (19) for rotatably supporting the workpiece, at least two straightening bases (22) arranged a distance apart on said upper surface (24) of said machine base, said straightening bases (22) aligned between said workpiece holding fixtures;

a machine top plate (3) including a top surface (26) which is parallel to the top surface (24) of the machine base (2), said machine top plate (3) is rigidly supported above said machine base (2) by four vertical posts (4) positioned at the four extreme corners of the machine top plate (3);

a ram (5) having a lower surface (27) which faces and is parallel to the upper surface (24) of the machine base (2), said ram (5) being slidingly disposed within said vertical posts (4);

a straightening punch (17) extending from said ram (5) towards said upper surface (24) of said machine base (2);

a drive mechanism for reversibly raising and lowering said ram (5) relative to said machine base (2), said drive mechanism including a projection (8) extending from each of a first and second spaced apart side surfaces of the ram (5);

a shaft (11) connected to and rotatably supported by the machine top plate (3);

a motor (10) directly coupled to said shaft (11) for rotating said shaft (11);

a first cam disk (7) mounted to said shaft (11) adjacent to a first side surface of the machine top plate (3), a second cam disk (7) mounted to said shaft (11) adjacent to a second side surface of machine top plate (3);

and biasing means (15) positioned centrally on the top surface (26) of said machine top plate (3) for urging said projections (8) into pressing engagement with said cam disks (7) and urging said ram (5) vertically upwards away from the upper surface (24) of said machine base (2).

2. A machine as in claim 1, further comprising a measuring instrument (23) positioned on said machine base (2) between said straightening bases (22), whereby said measuring instrument (23) determines the deflection of the workpiece.

3. A machine as in claim 1, wherein said ram (5) is coupled to said machine top plate (3) and is movable relative to said machine top plate (3).

4. A machine as in claim 3, wherein said biasing means (15) is compression spring.

5. A machine as in claim 4, wherein said ram (5) is guided by linear guides (6), said linear guides (6) being fixed to said vertical posts (4) to come into sliding engagement with said ram (5).

6. A machine as in claim 5, wherein said lower surface (27) of said ram (5) travels perpendicular to an axis (18) of rotation of a workpiece (21).

7. A machine as in claim 6, wherein the range of movement of the ram (5) corresponds to an angle of traverse of the cam disks (7) which is more than 180 degrees.

8. A machine as in claim 7, wherein the angle of traverse of the cam disks (7) is 270 degrees.

9. A machine as in claim 8, wherein the motor is embodied as an electric motor.

10. A machine as in claim 9, wherein the motor is fixedly supported by the machine top plate (3).

11. A machine as in claim 10, wherein the drive mechanism (10) includes a gear unit directly coupling the motor to the shaft (11).

12. A machine as in claim 11, wherein the projection (24) is a roller.

13. A machine as in claim 12, wherein the shaft (11) is rotatably supported on bearings in the machine top plate (3) and the cam disks (7) are fixedly connected to the shaft (11).

14. A machine as in claim 13, wherein an axis of rotation (12) of said shaft (11) is positioned horizontally parallel above said axis of rotation (18) of said workpiece (21) and said axes lie in the same vertical plane.

* * * * *